US006361375B1

(12) United States Patent
Sinclair

(10) Patent No.: US 6,361,375 B1
(45) Date of Patent: Mar. 26, 2002

(54) CLAMP-ON MULTIPLE LUG BUSS BAR ASSEMBLY

(76) Inventor: Kenneth E. Sinclair, 6949 Town View La., San Diego, CA (US) 92120

( * ) Notice: Subject to any disclaimer, the term of this patent is extended or adjusted under 35 U.S.C. 154(b) by 0 days.

(21) Appl. No.: 09/767,741

(22) Filed: Jan. 23, 2001

(51) Int. Cl.[7] ..... H01R 11/09

(52) U.S. Cl. ..... 439/723; 439/957; 439/721; 439/798

(58) Field of Search ..... 439/798, 721, 439/921, 723, 724, 957; 174/152 R, 71 B, 5 B, 88 B, 70 B, 79 B

(56) References Cited

U.S. PATENT DOCUMENTS 4,925,332 A * 5/1990 Griffith ..... 403/373
5,915,998 A * 6/1999 Stidham et al. ..... 439/723
5,931,708 A * 8/1999 Annas et al. ..... 439/798

* cited by examiner

*Primary Examiner*—Paula Bradley
*Assistant Examiner*—James R. Harvey
(74) *Attorney, Agent, or Firm*—Charles C. Logan, II

(57) ABSTRACT

A clamp-on multiple lug buss bar assembly that is attached to the electrical terminal stud that extends upwardly from the top surface of an electrical power transmission transformer that is used in an underground transformer vault. After its installation, a mold is placed thereover with its bottom edge contacting the top surface of the transformer. The height of the mold is such that it covers the top edge of the conductor plates that form part of the buss bar assembly. Additionally the mold has risers extending up from its top surface that surround the bottom end of the spade connector fingers extending upwardly from the conductor plates. The cavity of the mold is filled with an epoxy resin and when it has set forms a water tight casing for the electrical conductor plates, the electrical terminal stud extending upwardly from the transformer and the top wall of the transformer.

11 Claims, 9 Drawing Sheets

FIG 15
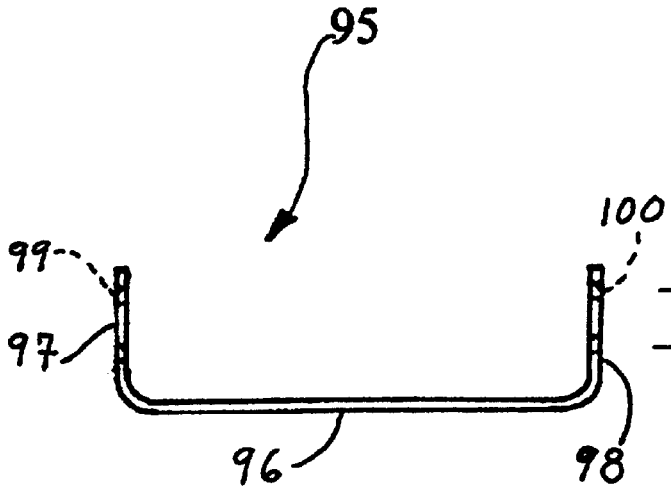
FIG 17
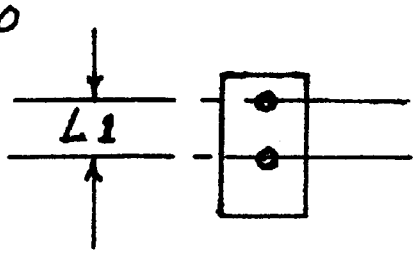
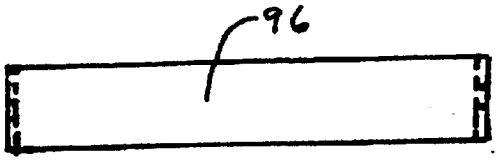
FIG 16

CLAMP-ON MULTIPLE LUG BUSS BAR ASSEMBLY

BACKGROUND OF THE INVENTION

The invention relates to an electrical connection assembly and more specifically to a clamp-on multiple lug buss bar assembly that would be utilized with a transformer located in an underground vault.

Presently when making electrical connections to a transformer in an underground vault, there can be a major height or space problem in the interior. The terminals of the transformer extend upwardly from its top surface in the form of threaded stud members. Transformer lugs are usually attached. Spade buss moles or other multiple attachment devices may then be bolted into a lengthy assembly, which may cause the service cables to be bent severely and interfere with their installation. This assembly is entirely supported by the threaded stud of the transformer. Thus the assembly and the associated cables attached to it, can by moment arm and mass, lever the stud to the point of cracking the epoxy seal surrounding the threaded stud. This would cause the premature failure of the transformer.

The assembly is made by connecting pieces of different metals. In order to protect the assembly against moisture, electrolysis and electrically insulate, sealant and protective tapes are hand placed around it. This taping is a labor intensive operation and it involves many repetitive motion acts of the nature which contributes to "Carpal Tunnel Syndrome".

It is an object of the invention to provide a novel clamp-on multiple lug buss bar assembly having a much reduced height for use on a transformer in an underground transformer vault.

It is also an object of the invention to provide a novel clamp-on multiple lug buss bar assembly with a wide base that distributes the stress on the threaded stud electrical terminal of the underground transformer.

It is another object of the invention to provide a novel clamp-on multiple lug buss bar assembly that completely encapsulates the threaded stud electrical terminal on the top of the transformer into a premolded form.

It is an additional object of the invention to provide a novel clamp-on multiple lug buss bar assembly that is easily and quickly installed on the threaded stud electrical terminal of a transformer.

It is a further object of the invention to provide a novel clamp-on multiple lug buss bar assembly that is economical to manufacture and market.

It is also an object of the invention to provide a simple and economical system of electrically connecting any two studs of a four stud transformer.

SUMMARY OF THE INVENTION

The clamp-on multiple lug buss bar assembly has been design primarily for use in an underground transformer vault. The basic components are a two-piece nut unit, a pair of conductor plates having different configurations, a spacer block and a connecting buss member. With these different components, various assembled embodiments can be made depending on the specific application.

Once the required components have been decided upon, they are assembled together in a loose fashion so that the two-piece nut unit can be mounted on the threaded stud electrical terminal extending from the top surface of a transformer. Once the internal threads of the two-piece nut unit have been matched with the threads of the stud, the nuts are tightened on the bolts holding the components together and the entire structure becomes a rigid structure. Next a mold is placed over the top of the conductor plates and the top of the mold would be slightly above the top edge of the body portion of the conductor plates. The spade connector fingers would extend upwardly through apertures in the top wall of the mold. Riser tubes would be inserted into these apertures and surround the individual spade connector fingers. Alternatively, the risers could be integrally formed with the top wall of the mold. Next an epoxy resin would be poured into the cavity formed in the mold through the risers and it would adhere to the top surface of the transformer and provide a watertight seal surrounding the threaded stud electrical terminals. Each of the spade connector fingers would benefit from the distribution of the stress to threaded stud electrical terminals by the solid mass of epoxy that extends laterally from the axis of the stud members. The mold could be left in place but it is preferable that it be quickly disassembled so that it can be reused. The reduced height of the clamp-on multiple lug buss bar assembly allows the spades of the secondary electrical distribution cables to be connected to the top of the respective spade connector fingers and have a gradual curved configuration as they travel upwardly and transversely to their distribution destination. Molds of a larger configuration could be used when two studs are joined, thus encapsulating the buss internally. This could be used to parallel the two 120V coils of a four stud transformer (two large moldings) or connect in series for a 120/240V three wire (one small molding on each side and one large molding for the neutral connection).

DESCRIPTION OF THE DRAWINGS

FIG. 15 is a top plan view of a connecting buss member;

FIG. 16 is a front elevation view of the connecting buss member;

FIG. 17 is a side elevation view of the connecting buss member; and

DESCRIPTION OF THE PREFERRED EMBODIMENT

Figure 1:
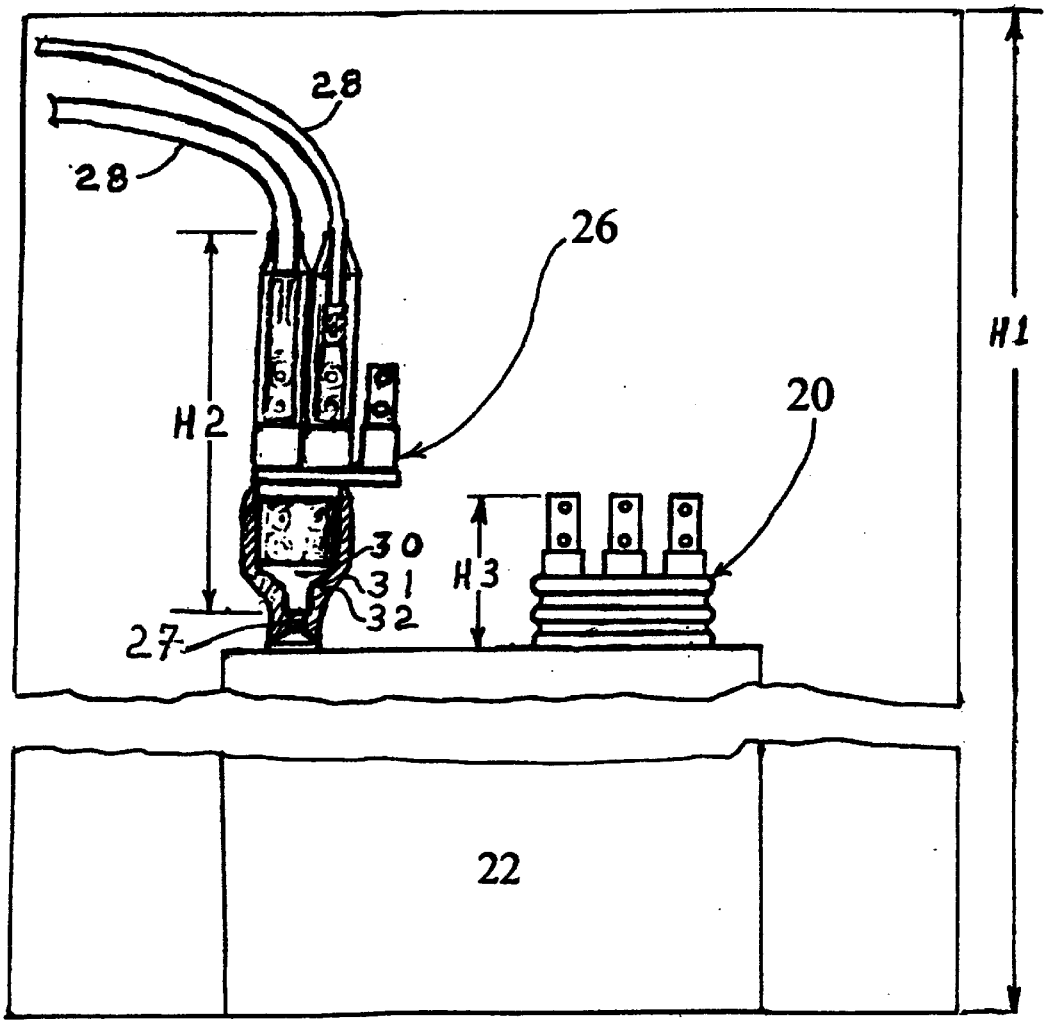
FIG. 1 is a schematic front elevation view of an underground transformer vault.
Figure 2:
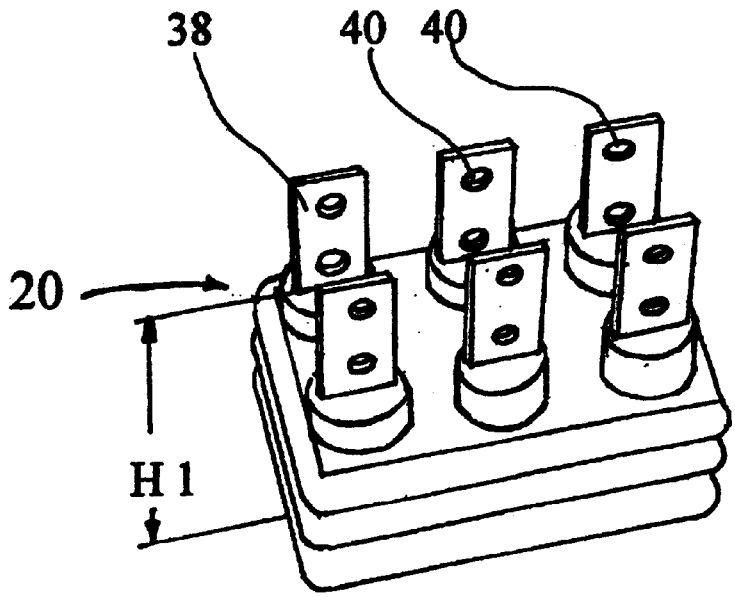
FIG. 2 is a front perspective view of the clamp-on multiple lug buss bar assembly.
Figure 3:
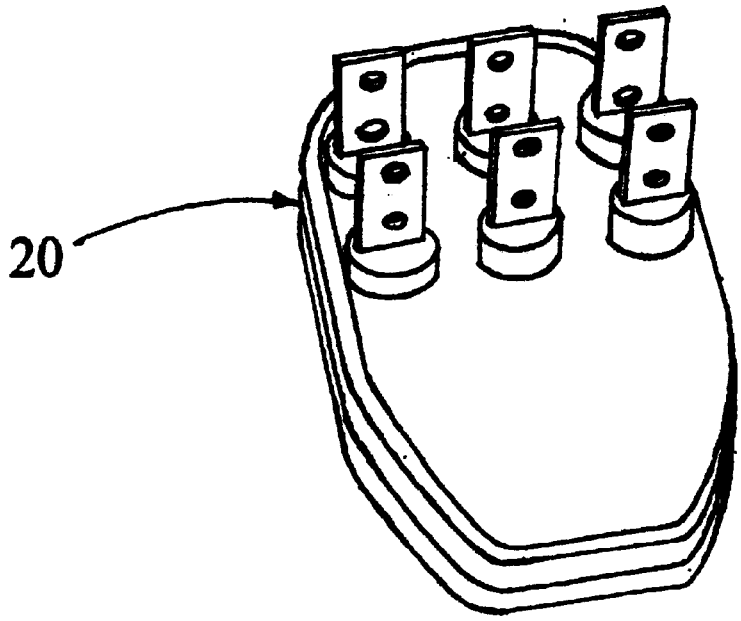
FIG. 3 is a front perspective view of a first alternative embodiment of the clamp-on multiple lug buss bar assembly.

The novel clamp-on multiple buss bar assembly will now be described by referring to FIGS. 1–18 of the drawings. FIG. 1 illustrates the clamp-on multiple buss bar assembly 20 mounted on the top surface of a transformer 22 positioned in an underground transformer vault 24. Transformer vault 24 has height H1 in the range of 60–96 inches. A prior art electrical connection 26 is mounted on a threaded stud electrical terminal 27 extending upwardly from the top wall of transformer 22. An electrical cable 28 is connected to its top end. Electrical connection 26 has a height H2 in the range of 12–18 inches and this necessitates a right angle bend in electrical cables 28. Clamp-on multiple buss bar assembly 20 has a height H3 in the range of 6–8 inches. Prior art electrical connection 26 has a double ended spade 30 that is connected to the top end of electrical terminal 27 and it is wrapped and covered by layers of sealant compound 32 and tape 31. FIGS. 2 and 3 illustrate alternative embodiments of the clamp-on multiple buss bar assembly 20.

Figure 4:
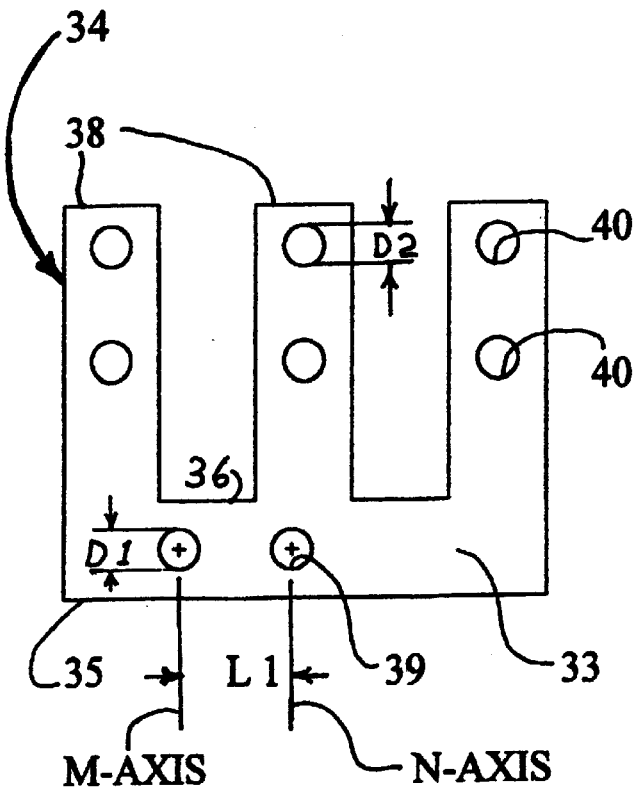
FIG. 4 is front elevation view of a conductor plate.
Figure 5:
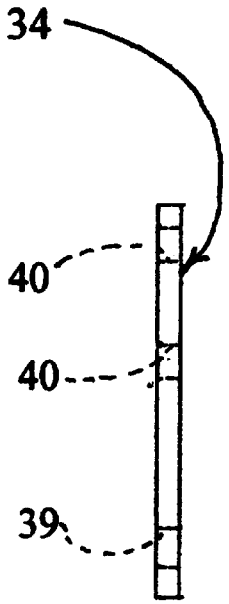
FIG. 5 is a side view of FIG. 4.
Figure 6:
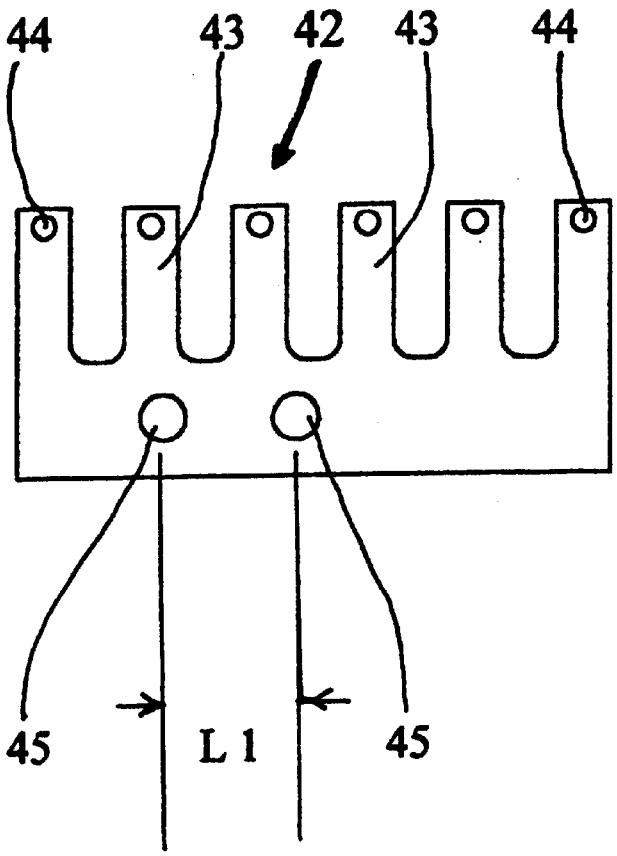
FIG. 6 is a front elevation view of an alternative conductor plate.
Figure 7:
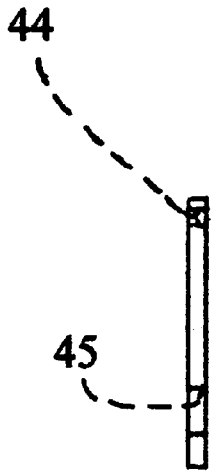
FIG. 7 is a side view of FIG. 6.

A first conductor plate 34 is illustrated in FIGS. 4 and 5. It has a body portion 33 having a bottom edge 35, a top edge 36 and a plurality of spade connector fingers 38. A pair of transversely extending bore holes 39 have their axes spaced from each other by distance L1. A plurality of apertures 40 are formed in spade connector fingers 38 for detachably securing the spades of secondary electrical conductor lines. The diameter of bore hole 39 is D1 and the diameter of apertures 40 is D2. A first alternative conductor plate 42 is illustrated in FIGS. 6 and 7 and the major difference is that it has six spade connector fingers 43 as opposed the other embodiment that only has three, they are also shorter and their threaded holes 44 are smaller. The axes for the apertures 45 are also separated by a distance L1. Thus any number of fingers or design variants are possible by changing conductor plates and corresponding epoxy molds.

Figure 8:
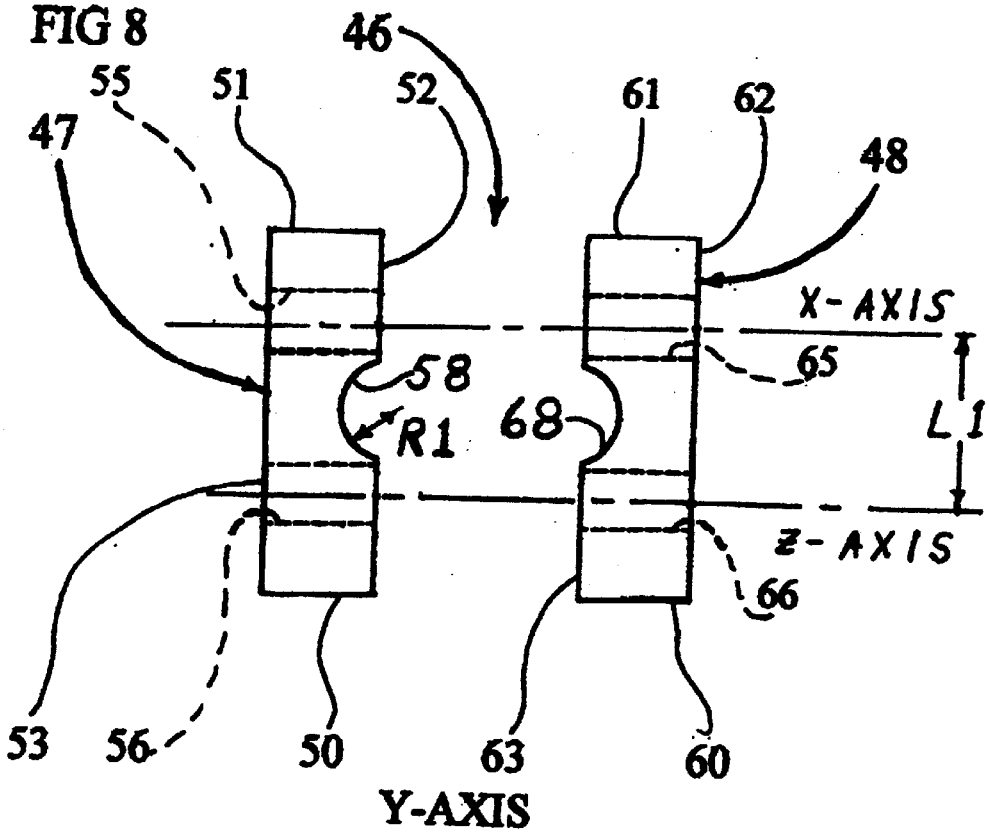
FIG. 8 is a top plan view of the novel split nut.
Figure 9:
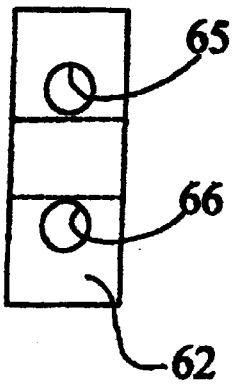
FIG. 9 is a right side elevation view of the split nut.
Figure 10:
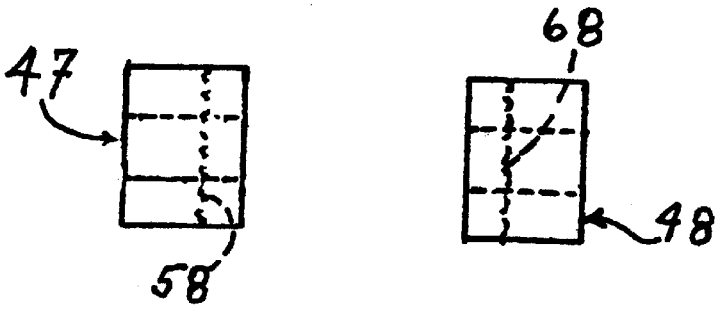
FIG. 10 is front elevation view of the split nut.
Figure 11:
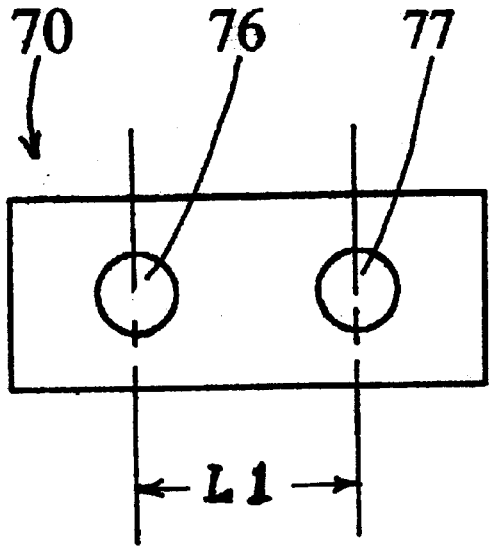
FIG. 11 is a front elevation view of the spacer block.
Figure 12:
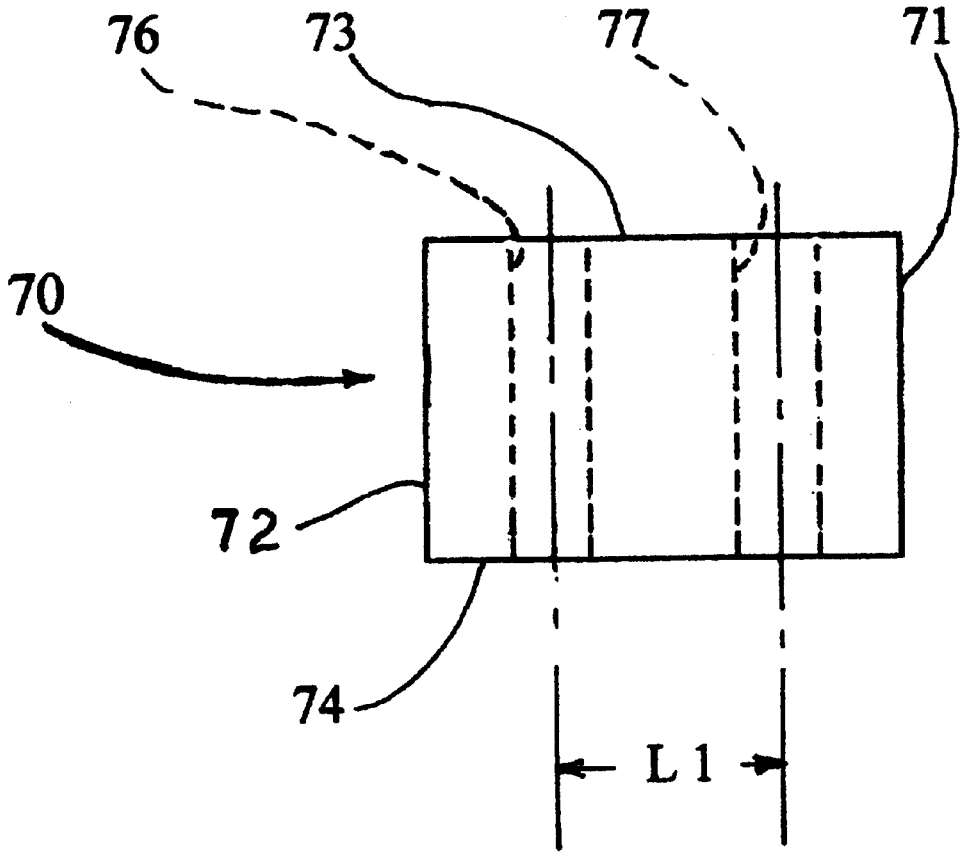
FIG. 12 is a top plan view of the spacer block.

The two-piece split nut unit 46 is illustrated in FIGS. 8–10. It has a left half member 47 and a right half member 48. Left half member 47 has a front wall 50, a rear wall 51, a right side wall 52 and a left side wall 53. It also has a bore hole 55 having a X-axis and a bore hole 56 having a Z-axis. The distance between these two axes is L1. Right side wall 52 has a semi-cylindrical recess 58 having a radius R1 and a Y-axis. Semi-cylindrical recess 58 also has internal threaded grooves. Right half member 48 has a front wall 60, a rear wall 61, a right side wall 62 and a left side wall 63. Bore hole 65 has a X-axis and bore hole 66 has a Z-axis. A semi-cylindrical recess 68 is formed in left side wall 63. It also has a radius Ri and it has internal threaded grooves.

Spacer block 70 has a front wall 71, a rear wall 72, a right side wall 73 and a left side wall 74. A laterally extending bore hole 76 has an X-axis. A laterally extending bore hole 77 has a Z-axis. The distance between the X-axis and the Z-axis is L1.

Figure 13:
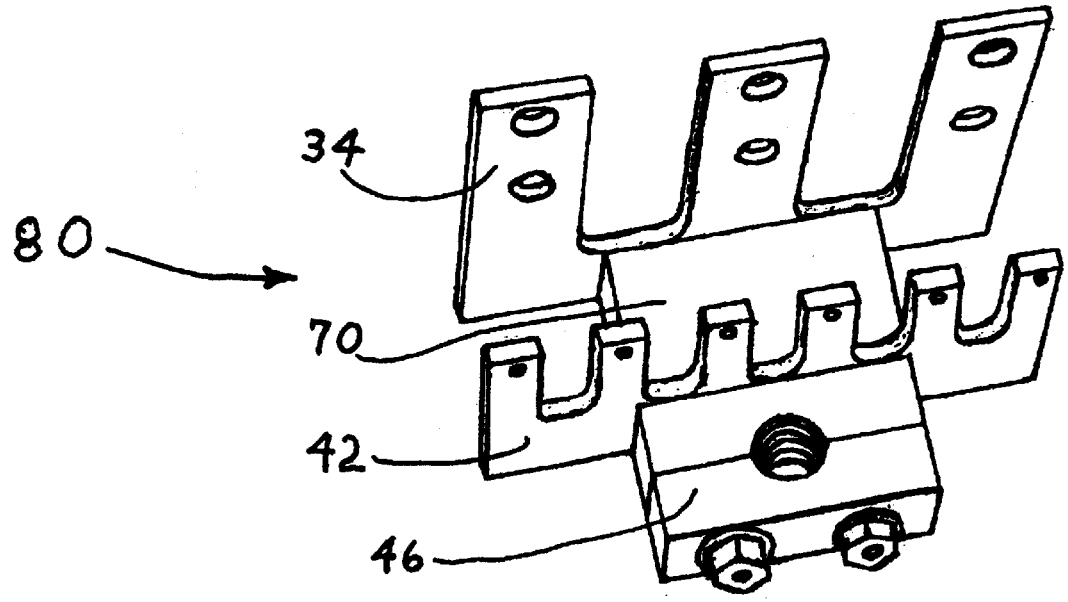
FIG. 13 is a front perspective view of a second alternative embodiment of the clamp-on multiple lug buss bar assembly.

FIG. 13 is a second alternative embodiment of the clamp-on multiple buss bar assembly and it is generally designated numeral 80. It has a two-piece nut unit 46 that is first connected to a conductor plate 42. To this structure is attached a spacer block 70 and after this a conductor plate 34. All of the respective components are held together by a pair of bolts that pass through their respective bore holes and each have a nut and washer on their ends. The clamp-on multiple buss bar assembly 80 would be attached to the stud terminal 27 extending upwardly from the top surface of transformer 22. Once tightly clamped thereon, a mold would be lowered over the clamp-on multiple buss bar assembly until its bottom edge is in contact with the top surface of transformer 22. The mold would have a top wall with risers extending upwardly therefrom. An epoxy resin would be poured in through these risers and it would fill the cavity of the mold and also adhere to the top surface of transformer 22.

Figure 14:
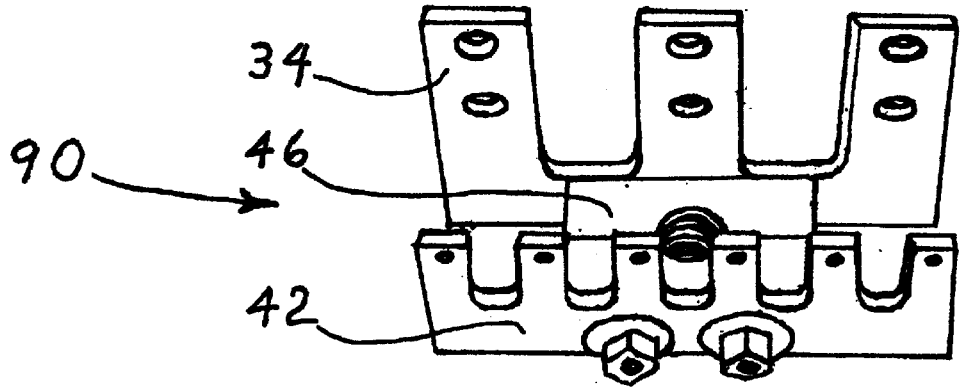
FIG. 14 is a front perspective view of a third alternative embodiment of the clamp-on multiple lug buss bar assembly.

A third alternative embodiment of the clamp-on multiple lug buss bar assembly is designated numeral 90 and it is illustrated in FIG. 14. It has a conductor plate 42 and a conductor plate 34 secured to opposite sides of a split nut unit 46. The manner in which it would be attached to the threaded stud 27 is identical to that which has been previously described.

Figure 18:
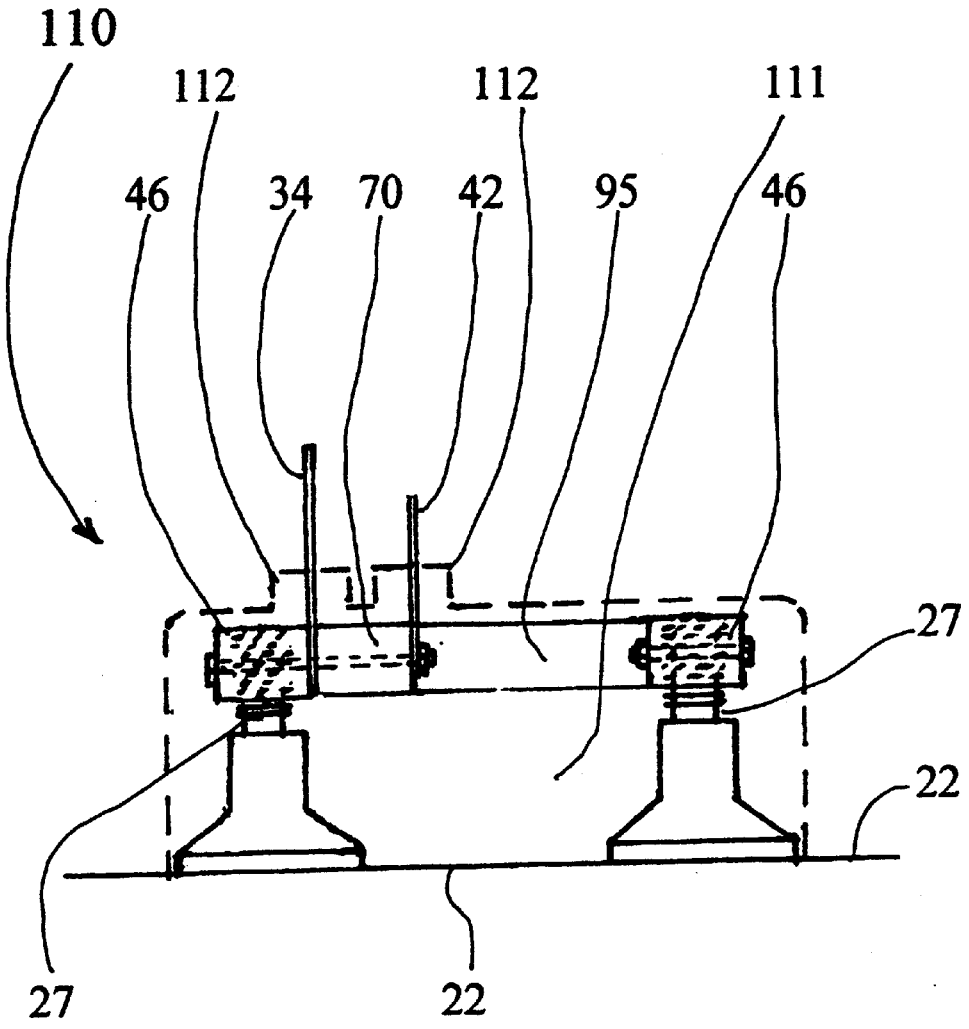
FIG. 18 is a schematic front elevation view of a fourth alternative embodiment of the clamp-on multiple buss bar assembly.

A connecting buss member 95 is illustrated in FIGS. 15–17. It has a front wall 96 and flanges 97 and 98. Apertures 99 and 100 are formed in the respective flanges. In FIG. 18, two electrical studs 27 are illustrated extending from the top surface of transformer 22. To the left, stud 27 is attached in sequence a split nut unit 46, a conductor plate 34, a spacer 70, and a conductor plate 42. A split nut unit 46 is attached to the right stud 27 and connected between this stud and conductor plate 42 is a buss member 95. A mold 110 having risers 112 covers the clamp-on multiple lug buss assembly and its cavity would be filled with an epoxy 111 resin that seals both the stud electrical terminals 27 and the remainder of the connections against any moisture or liquid penetration that might cause a short.

What is claimed is:

1. A clamp-on multiple lug buss bar assembly comprising:

a two-piece nut unit having a left half member and a right half member;

said left half member having a front wall, a rear wall, a left side wall, a right side wall, a top wall and a bottom wall; a first bore hole having an X-axis extends from said left side wall to said right side wall; a second bore hole having a Z-axis extends from said left side wall to said right side wall; said X-axis and said Z-axis being parallel and laterally spaced from each other a distance L1; a semi-circular recess formed in said right side wall and it extends from said top wall to said bottom wall; said semi-cylindrical recess having a radius R1 and a longitudinal Y-axis;

said right half member having a front wall, a rear wall, a left side wall, a right side wall, a top wall and a bottom wall; a first bore hole having an X-axis extends from said left side wall to said right side wall; a second bore hole having a Z-axis extends from said left side wall to said right side wall; said X-axis and said Z-axis being parallel and laterally spaced from each other said distance L1; a semi-cylindrical recess formed in said left side wall and it extends from said top wall to said bottom wall; said semi-cylindrical recess having said radius R1 and a longitudinally extending Y-axis; when said left half member and said right half member are assembled together around a threaded stud that extends upwardly from a top wall of a transformer, the respective semi-cylindrical recesses mate with each other to form a cylindrical bore hole;

a first vertically oriented elongated conductor plate having a bottom edge and a top edge; a plurality of spade connector fingers each having a top end and a bottom end extend upwardly from said top edge of a body portion; a pair of transversely extending apertures in said body portion and they have respectfully a M-axis and a N-axis that are spaced from each other said distance L1; and means for fastening said first conductor plate to said two-piece nut unit with said M-axis and said N-axis of said conductor plate aligned respectively with said X-axis and Z-axis of said two-piece nut unit.

2. A clamp-on multiple lug buss bar assembly as recited in claim 1 further comprising means on said spade connector fingers for attaching a spade on the end of an electrical conductor line.

3. A clamp-on multiple lug buss bar assembly as recited in claim 1 further comprising a second vertically oriented elongated conductor plate having a body portion having a bottom edge and a top edge; a plurality of spade connector fingers each having a top end and a bottom end extending upwardly from said top edge of said body portion; a pair of transversely extending apertures in said body portion and they have respectfully said M-axis and said N-axis that are spaced from each other said distance L1; said first conductor plate being positioned against said left side wall of said left side member and said second conductor plate being positioned against said right side wall of said right half member.

4. A clamp-on multiple lug buss bar assembly as recited in claim 1 further comprising a spacer block having a left side wall and a right side wall, a pair of transversely extending apertures in a body portion and they have respectively said M-axis and said N-axis that are spaced from each other said distance L1; and said first conductor plate is positioned against said right side wall of said right half member; said spacer block is positioned against said left side wall of said first conductor plate; and said conductor plate is positioned adjacent said right side wall of said spacer block.

5. A clamp-on multiple lug buss bar assembly as recited in claim 4 further comprising a connecting buss member and a second two-piece nut unit; said connecting buss member having a left end, a right end and a front wall; means connecting said left end of said connecting buss member to said second conductor plate and said second two-piece nut unit to said right end of said connecting buss member.

6. A clamp-on multiple lug buss bar assembly as recited in claim 1 in combination with an electrical power transmission transformer having at least one electrical stud extending upwardly from a top surface and said clamp-on multiple lug buss bar assembly is mounted thereon.

7. A clamp-on multiple lug buss bar assembly as recited in claim 6 wherein a mold having a top edge, a bottom edge and an interior cavity is placed over said clamp-on multiple lug buss bar assembly with said bottom edge of said mold resting on said top surface of said electrical power transmission transformer and said cavity is filled with an epoxy resin to a height at least over said top edge of said first conductor plate.

8. A clamp-on multiple lug buss bar assembly as recited in claim 7 wherein said mold has a top wall with risers extending upwardly around said spade connector fingers a predetermined height and said epoxy resin fills said risers.

9. A clamp-on multiple lug buss bar assembly as recited in claim 1 wherein said left and right half members are solid blocks made of electrically conductive material.

10. A clamp-on multiple lug buss bar assembly as recited in claim 9 wherein said electrically conductive material is copper brass or other suitable conductor.

11. A clamp-on multiple lug buss bar assembly as recited in claim 1 wherein said semi-cylindrical recesses on the mating side walls of said left and right half members have threaded grooves thereon.

* * * * *